US008684895B2

(12) United States Patent
Severing et al.

(10) Patent No.: US 8,684,895 B2
(45) Date of Patent: Apr. 1, 2014

(54) ROLLER BODY FOR A ROLLER FOR TREATING A MATERIAL AND METHOD OF MANUFACTURING A ROLLER BODY

(75) Inventors: Ulrich Severing, Kirchheim (DE); Bernd Eppli, Koenigsbronn (DE); Lutz Krodel-Teuchert, Camburg (DE)

(73) Assignee: SHW Casting Technologies GmbH, Aalen (DE)

( * ) Notice: Subject to any disclaimer, the term of this patent is extended or adjusted under 35 U.S.C. 154(b) by 948 days.

(21) Appl. No.: 12/686,700

(22) Filed: Jan. 13, 2010

(65) Prior Publication Data

US 2010/0179039 A1 Jul. 15, 2010

(51) Int. Cl.
*F16C 13/00* (2006.01)

(52) U.S. Cl.
USPC ..... 492/58; 492/1; 492/20; 492/26; 492/48; 492/54

(58) Field of Classification Search
USPC ..... 492/20, 26, 46, 48, 53, 54, 58, 1
See application file for complete search history.

(56) References Cited

U.S. PATENT DOCUMENTS

| | | | | | |
|---|---|---|---|---|---|
| 3,065,070 | A | * | 11/1962 | Otani | 420/30 |
| 3,411,957 | A | * | 11/1968 | Matsukura et al. | 148/544 |
| 3,997,370 | A | * | 12/1976 | Horvath et al. | 72/365.2 |
| 4,771,524 | A | | 9/1988 | Barbezat et al. | |
| 4,990,194 | A | * | 2/1991 | Obata et al. | 148/543 |
| 5,072,497 | A | * | 12/1991 | Zaoralek et al. | 492/46 |
| 5,334,125 | A | | 8/1994 | Vaehaepesola | |
| 5,383,833 | A | * | 1/1995 | Brugger et al. | 492/16 |
| 5,549,154 | A | * | 8/1996 | Niskanen et al. | 165/89 |
| 5,611,143 | A | * | 3/1997 | Graf | 29/895.3 |
| 5,932,069 | A | * | 8/1999 | Kuosa et al. | 162/199 |
| 7,018,512 | B2 | * | 3/2006 | von Schweinichen et al. | 162/361 |
| 2004/0071584 | A1 | * | 4/2004 | Molinari et al. | 420/27 |
| 2006/0037675 | A1 | | 2/2006 | Labbe | |
| 2011/0274946 | A1 | * | 11/2011 | Severing et al. | 428/683 |

FOREIGN PATENT DOCUMENTS

| | | | | | |
|---|---|---|---|---|---|
| CH | 211 984 | | | 1/1941 | |
| CH | 360 701 | | | 4/1962 | |
| DE | 36 40 131 | | | 8/1987 | |
| DE | 692 19 808 | | | 10/1997 | |
| DE | 10 2005 051 715 | | | 5/2006 | |
| EP | 0 505 343 | | | 9/1992 | |
| EP | 0-710 741 | | | 5/1996 | |
| EP | 2213790 | A1 | * | 8/2010 | D21G 1/00 |
| JP | 60250815 | A | * | 12/1985 | B21B 27/02 |
| JP | 61210151 | A | * | 9/1986 | C22C 37/04 |
| JP | 01152240 | A | * | 6/1989 | C22C 38/04 |
| JP | 08215721 | A | * | 8/1996 | B21B 28/02 |
| JP | 2007245217 | A | * | 9/2007 | B21B 27/00 |
| JP | 2009066633 | A | * | 4/2009 | B21B 27/00 |
| WO | WO 2006/072663 | | | 7/2006 | |

OTHER PUBLICATIONS

German Office Action for DE 10 2009 004 562.7 dated Oct. 21, 2009.

* cited by examiner

*Primary Examiner* — Essama Omgba
(74) *Attorney, Agent, or Firm* — RatnerPrestia

(57) ABSTRACT

A roller body for a roller for treating a material, preferably a web material, which is cast from an iron base alloy which forms a radially interior zone (5) of the roller body (1) made of grey cast iron (GJS, GJV) and, around the interior zone (5), a circumferential rim zone (6) which includes the outer circumference of the roller body (1) and exhibits a surface hardness which is greater than 400 HV, wherein the circumferential rim zone (6) consists of ribbon grain or superfine ribbon grain pearlite (P) with embedded free graphite, preferably spheroidal graphite (SG) or vermicular graphite (V), or of an intermediate structure (ADI) with spheroidal graphite or vermicular graphite.

12 Claims, 3 Drawing Sheets

ROLLER BODY FOR A ROLLER FOR TREATING A MATERIAL AND METHOD OF MANUFACTURING A ROLLER BODY

CROSS-REFERENCE TO RELATED APPLICATIONS

This application claims priority to German Patent Application No. DE 10 2009 004 562.7 filed Jan. 14, 2009, the contents of such application being incorporated by reference herein in its entirety.

FIELD OF THE INVENTION

The invention relates to a roller body for a roller for treating a material, preferably for thermally or mechanically treating a web material. The invention also relates to a method for manufacturing such roller bodies. The roller body can already be a constituent of a roller which comprises trunnion flanges at the axial ends of the roller body in order to be rotationally mounted. The invention also, however, relates to the roller body itself, before it is assembled with other components to form a roller.

BACKGROUND OF THE INVENTION

In paper manufacturing—a preferred application of roller bodies in accordance with the invention—rollers which are several metres in length and more than a metre in diameter are used to manufacture the finished paper web from cellulose sludge by means of thermal and mechanical treatment. Rollers made of a chilled casting, in particular clear chilled casting, or forged steel are used. The roller bodies made of a chilled casting are manufactured in a gravity die casting method, in most cases upright by static gravity die casting. The annular dies mean that a carbidic, white cast iron is achieved in the outer circumferential rim zone, the shell. The circumferential rim zone or shell solidifies metastably, white, and the carbon there is bound in the form of carbides. Stable solidification occurs in the core, where the molten mass solidifies grey and the carbon occurs as free graphite in the iron matrix. The required hardness at the outer circumference of the roller body, the surface hardness, is ensured by the material of the shell—the white cast iron. The hardness at the surface and in the near-surface depth range is set via the die and the alloy elements of the iron base molten mass. Negative effects of a clear chilled casting include the impact brittleness, a sensitivity to sudden changes in temperature, and uneven wear at the outer circumference of the roller due to the carbides contained in the white cast iron.

In order to overcome said disadvantages, EP 0 505 343 A1 proposes casting the roller body from an iron base alloy, such that a pearlitic or ferritic-pearlitic micro-structure is created which is at least 60% pearlitic. The iron base alloy contains 3.0% to 3.8% carbon, 1.5% to 3.0% silicon and 0.5% to 0.9% manganese. Maximum amounts for phosphorus and sulphur are specified. Chromium, nickel, copper, magnesium, molybdenum, tin or aluminium are used as additional alloy elements. The cast roller body is surface-hardened—induction and flame hardening are mentioned—and tempered after the martensitic transformation, such that the roller body obtains a tempered martensitic structure in its circumferential rim zone. The martensitic structure of the circumferential rim zone is associated with a considerable danger of fractures.

Using the alternative of roller bodies made of forged steel, as mentioned at the beginning, it is possible to solve said material problems. The surface hardness and hardness penetration depth of the roller body are set by subsequent thermal surface treatment. It is however manufactured from a forging grade ingot, the weight of which depends on the size of the roller body. Roller bodies such as the invention relates to weigh many tonnes—large roller bodies for example have a weight of about 50 t or even more. The weight of the forging grade ingot for such roller bodies can be up to 200 t. In this weight range, hollow-forging is only possible at very great cost. This additionally makes great demands on the interior quality of the forged steel with regard to flaws, inclusions and the like. The yield is therefore very low.

It is an object of the invention to provide, at a favourable price, a roller body having improved mechanical properties as compared to a clear chilled casting. The roller body shall be able to replace the known roller bodies made of a clear chilled casting and shall in particular exhibit the required hardness at its surface and also in the near-surface depth range, but not the unevenness of wear and impact brittleness which are disadvantageous in applications. The danger of fractures which is associated with a martensitic shell shall likewise be avoided.

DETAILED DESCRIPTION OF THE INVENTION

The invention proceeds from a roller body which is cast from a single iron base alloy. The iron base alloy in the roller body forms a radially interior zone of the roller body made of grey cast iron, preferably a spheroidal graphite casting and, surrounding the interior zone, a circumferential rim zone which includes the outer circumference of the roller body and exhibits a surface hardness at the outer circumference which is greater than 400 HV, as is also the case with the clear chilled casting such as has been predominantly used hitherto. The roller body can consist of a solid material as viewed in cross-section, such that the radially interior zone made of grey cast iron forms a central core of the roller body. The roller body can instead also be a hollow roller shell, such that the radially interior zone is an annular zone. The interior zone and the circumferential rim zone are cast in one piece; the use of the two terms is intended to indicate the distinction in the microstructure—in the following, simply "structure"—which occurs in the two zones.

In accordance with the invention, the circumferential rim zone consists either of ribbon grain pearlite or superfine ribbon grain pearlite with vermicular graphite or preferably spheroidal graphite, or of an intermediate structure, preferably ADI with spheroidal or vermicular graphite. Ribbon grain pearlite is also referred to as sorbite, and superfine ribbon grain pearlite is also referred to as troostite. The invention combines the advantages of cast roller bodies with those of roller bodies made of forged steel and avoids the danger of fractures associated with a martensitic shell. As a cast body, it can be manufactured over its entire axial length in one casting and thus significantly more cheaply than a roller body made of forged steel. The interior zone consisting of grey cast iron can be easily machined, for example by machine-cutting. It is thus possible to provide peripheral bores near the surface, for conducting a thermal fluid, in the interior zone. The hardness profile of the circumferential rim zone, i.e. the profile of the hardness plotted against the radius of the roller, corresponds at least to the hardness profile of conventional rollers and can be controlled by the heat treatment process. The mechanical stability, however, is significantly improved as compared to a clear chilled casting, as expressed in greater values for the 0.2% proof stress, tensile strength and elongation at rupture. The elongation at rupture is advantageously increased as compared to a tempered martensitic structure; in particular, the danger of fractures is significantly reduced.

In preferred embodiments, in which the free graphite of the circumferential rim zone occurs at least substantially as spheroidal graphite, the graphite pebbles which form the spheroidal graphite in the solidified circumferential rim zone have a maximum size which corresponds to an index value of at least 5 (0.06 to 0.12 mm) in accordance with EN ISO 945. Dispersing the graphite in the form of such small graphite pebbles only is likewise advantageous for the mechanical stability and is achieved in the casting process by adjusting the cooling speed of the molten mass. To this end, the molten mass is cooled from without, from the outer circumference, wherein the cooling speed is on the one hand low enough that a spheroidal graphite casting structure is achieved in the circumferential rim zone up to the outer circumference or practically up to the outer circumference, but on the other hand still high enough that the graphite pebbles of the circumferential rim zone are smaller than in conventional spheroidal graphite casting, for example when casting into a sand mould. It is particularly advantageous if the spheroidal graphite in the basic structure obtained in the circumferential rim zone by casting comprises almost only and preferably only graphite pebbles having a maximum size which corresponds to an index value of at least 6 (0.03 to 0.06 mm), even better at least 7 (0.015 to 0.03 mm), in accordance with EN ISO 945. The graphite pebbles of the spheroidal graphite casting structure which preferably also occurs in the interior zone can be comparatively larger. In the preferred embodiments explained, the proportional content of spheroidal graphite in the free graphite of the solidified circumferential rim zone is at least 80%, preferably at least 90%; and at least 90%, preferably at least 95%, of the graphite pebbles in the spheroidal graphite of the circumferential rim zone correspond to the above specifications for the size of the graphite pebbles. The standard mentioned is the currently valid EN ISO 945:1994. If the free graphite is dispersed in a vermicular form, said specifications with respect to the size and proportional contents in percent likewise apply to the vermicular graphite particles. Accordingly, the vermicular graphite particles, if present, exhibit a maximum size—in this case, the length—of 0.12 mm in preferred embodiments, more preferably at most 0.06 mm and even more preferably at most 0.03 mm. At least 90%, preferably at least 95%, of all the vermicular graphite particles present fall within this size range.

If the structure of the circumferential rim zone comprises carbides at all, the proportional content of them is below 5%; preferably, the proportional carbide content is at most 3%. Specifications of proportional content in percent are always understood to mean percent by mass, i.e. the proportional content, in percent, of the respective total mass. In relation to any proportional carbide content, this means that the proportional carbide content is less than 5% by mass and preferably at most 3% by mass of the total mass of the circumferential rim zone, including the proportional carbide content. For comparison: a white cast iron typically has a proportional carbide content of 15% or more. Due also to its significantly reduced proportional carbide content and the therefore reduced micro-notching effect, the material of the circumferential rim zone of the roller body in accordance with the invention exhibits significantly improved stability values as compared to white cast iron.

The roller body having the structure in accordance with the invention—a radially interior zone in a grey casting, preferably in a spheroidal graphite casting, and a circumferential rim zone in ribbon grain pearlite or superfine ribbon grain pearlite or as an intermediate structure, with vermicular or preferably spheroidal graphite in each case—can be a constituent of a roller for treating a material, said roller being either still outside of a machine or already installed in a machine, for example a paper machine. Accordingly, the roller comprises the roller body and a trunnion flange at each of the two axial ends of the roller body, in order to be rotationally mounted and optionally in order to introduce a torque or to supply or drain off a thermal fluid. The word "or" is understood in its usual logical sense and thus as an "inclusive or", i.e. it includes both the meaning of "either . . . or" and the meaning of "and", unless only a restricted meaning alone follows from the respectively specific context. In relation to the trunnion flanges of a roller, this means for example that the trunnion flanges can serve either only for rotationally mounting or for rotationally mounting and additionally only for introducing the torque or in another alternative for rotationally mounting and supplying or draining off a thermal fluid. It is also for example possible for one of the trunnion flanges to fulfil all four functions in combination, i.e. to serve for rotationally mounting and introducing a torque and for supplying and draining off a thermal fluid. The invention also relates to a roller body itself, which is only provided for assembly with other components of such a roller, for example the trunnion flanges mentioned. The roller body in accordance with the invention is at least finished to the extent that it is not subjected to any further thermal treatment which specifically serves to adjust the micro-structure. This, however, excludes any secondary treatment, for example grinding or polishing, optional machine-cutting or for example also mechanical training and in principle also thermal treatments which in particular do not alter the structure claimed for the circumferential rim zone to such an extent that it no longer corresponds to the claimed invention.

The roller or roller body can in particular be used for thermally or mechanically treating a web material, preferably in paper manufacturing, for example as a smoothing roller or calender roller. In the treatment of web material, the roller or roller body can also be used as an embossing roller in order to engrave web material, for example a non-woven web material. Another preferred application is material comminution. The roller or roller body can then for example be used to crush hops or other fruits, in an example scenario as a crushing roller or crushing roller body.

A method for manufacturing the roller body comprises at least the following steps: the roller body is cast from a molten mass of an iron base alloy, such that the molten mass solidifies stably as cast iron in both the radially interior zone of the roller body and the radially adjacent circumferential rim zone which extends as far as the outer circumference, and solidifies in a spheroidal graphite casting structure or a cast structure with vermicular graphite in at least the circumferential rim zone and preferably also the interior zone. The matrix of the cast iron is pearlitic/ferritic, wherein the proportional pearlite content should be greater than 90% and the proportional ferrite content should be smaller than 10%. The proportional pearlite content in the cast iron matrix is preferably greater than 95% and the proportional ferrite content is preferably smaller than 5%. Any proportional carbide content is smaller than 5% in the circumferential rim zone, preferably smaller than or at most equal to 3%. The roller body obtained using this cast structure is hardened at its outer circumference, i.e. at its circumferential surface, and in the circumferential rim zone by means of a thermal surface treatment.

In accordance with the invention, the thermal surface treatment is performed in such a way that the cast material which forms the circumferential rim zone—cast iron with vermicular graphite or spheroidal graphite, wherein spheroidal graphite is preferred—is transformed into ribbon grain or superfine ribbon grain pearlite with vermicular graphite or spheroidal graphite or into an intermediate structure with spheroidal graphite or vermicular graphite. More specifically, the cast iron matrix is transformed into said pearlite or the intermediate structure, and the free graphite which has already been dispersed as a stable phase by casting is retained. The molten mass is also not cast into sand but rather die-cast, in order to be able to control the cooling speed. The gravity die casting can be performed statically or instead also dynamically, i.e. as a centrifugal casting method. The roller body is expediently cast upright, i.e. with its longitudinal axis vertically aligned. Die-casting allows the cooling speed to be more precisely set, in particular by choosing the thickness of the die as measured radially with respect to the longitudinal axis of the roller body, the specific or absolute thermal capacity, the thermal conductivity or the mass of the die, or a suitable combination of such adjustment parameters on the part of the die. As compared to conventional clear chilled casting, which is usually likewise performed in a gravity die casting method but with a white solidifying circumferential rim zone, the cooling speed can be controlled for example by means of one or preferably a combination of several of the following measures, each as compared to a die for casting a roller body having the same geometry and the same material, in a conventional clear chilled casting: a lower die thickness; using a die made of a material having a lower thermal capacity; using a die having a lower thermal conductivity; a lower die mass.

In preferred embodiments, the cooling speed is set by die-cooling to be not only low enough that the molten mass solidifies stably, even in the circumferential rim zone, but also high enough that, as explained above for the preferred spheroidal graphite, the spheroidal graphite in the circumferential rim zone is dispersed in graphite pebbles having a maximum size corresponding to the index value 5, preferably a maximum size corresponding to the index value 6, in accordance with EN ISO 945. The graphite pebbles particularly preferably occur in a size range between 7 and 8 in accordance with EN ISO 945, i.e. at the index value 7/8. Dispersing the graphite this finely has a positive effect on the mechanical stability. Finely dispersing the graphite also increases the regularity of the surrounding cast iron matrix, which is in turn advantageous for transforming this basic structure, which occurs after casting, into ribbon grain or superfine ribbon grain pearlite or into an intermediate structure.

The thermal surface treatment hardens the roller cast body up to a radial depth of advantageously at least 3 mm, preferably at least 5 mm, by transforming the cast iron matrix into ribbon grain or superfine ribbon grain pearlite or the intermediate structure up to at least this hardness penetration depth. A hardness penetration depth of 7 mm is the optimum hardness penetration depth for the size range of roller bodies which the invention is primarily directed to. While a hardness penetration depth of over 10 mm is not to be excluded as a possibility, large hardness penetration depths do however generate material stresses in the event of changes in temperature which are associated with the danger of the hardened layer—the circumferential rim zone—peeling off. Flame hardening and induction hardening can in particular be considered as methods for the thermal surface treatment, wherein induction hardening is preferred since flame hardening is limited to the lower range of the hardness penetration depth—generally, even below 3 mm. Flame hardening is therefore primarily considered for roller bodies with small diameters of up to 600 mm, although induction hardening is also preferred in this case. The circumferential rim zone is temporarily heated into the austenitic range, preferably to at least 880° C. and particularly preferably to about 950° C., depending on the desired surface hardness and hardness penetration depth. The heated material is cooled to below 100° C., preferably below 50° C., within a short period of time by surface cooling, preferably by means of quenching with water, such that the material is isothermally transformed into ribbon grain or superfine ribbon grain pearlite. If the cast iron of the circumferential rim zone is to be transformed into an intermediate structure, a higher cooling speed is set, which however is still not high enough for any appreciable martensitic transformation to occur. Ideally, martensite is completely avoided, due to the danger of fractures associated with it. In preferred embodiments, the cast iron of the circumferential rim zone therefore exhibits a martensite starting temperature $M_s$ which is below the values specified above, i.e. below 100° C., preferably below 50° C. The material of the circumferential rim zone particularly preferably exhibits a martensite starting temperature $M_s$ which is below room temperature, i.e. below 20° C.

The surface-hardened roller body is advantageously tempered in order to reduce stresses. The tempering temperature is above the maximum temperature which the roller body reaches in its subsequent operation, advantageously over 300° C.; a tempering temperature in the range of 300° C. to 350° C. is preferred. After being tempered in this way, the roller body still exhibits the ribbon grain or superfine ribbon grain pearlitic structure with spheroidal graphite or vermicular graphite or the intermediate structure with spheroidal graphite or vermicular graphite in its circumferential rim zone.

The iron base alloy has a carbon content of preferably at least 3% and preferably at most 4%. The silicon content is preferably at least 1.7% and at most 2.4%, wherein these are also, as always, percentages by mass. The degree of saturation of scandium in the alloy is preferably in the range of 0.97 to 1.03; it is preferably slightly smaller than 1.0, such that the molten mass is slightly hypoeutectic. A preferred co-constituent in the alloy is copper, as a pearlite former, and with a proportional content of preferably at least 0.5% and preferably at most 1.3%. A particularly preferred co-constituent in the alloy is also nickel, which is alloyed in a proportional content of preferably over 0.3%, even more preferably over 0.5%, and preferably at most 1.5%. Nickel increases the toughness and makes the material slower to corrode. Nickel is of particular value, however, for preventing a martensitic transformation during hardening. If the iron base alloy contains both silicon and nickel, it is advantageous if the silicon content decreases as the nickel content increases and if the nickel content decreases as the silicon content increases. A proportional silicon content from the lower half of the range specified for silicon and a proportional nickel content from the middle portion of the range specified for nickel are preferred. A particularly preferred iron alloy contains both nickel and copper as co-constituents in the alloy, preferably with at least the minimum proportional content specified for each of them. Optional co-constituents in the alloy also include manganese and tin, manganese preferably in the range of 0.3% to 0.45% and tin preferably in the range of 0.005% to 0.015%. However, the significance of manganese and tin recedes as compared to the other alloy elements mentioned above. Accordingly, a preferred iron base alloy contains carbon, silicon, nickel and copper, within the preferred proportional content limits, and possibly manganese and tin, as well as an unavoidable residual proportional content of phosphorus and sulphur, with the rest being iron. Any proportional content of phosphorus and/or sulphur, respectively, is advantageously significantly below 0.1% and more preferably even significantly below 0.05%.

Advantageous features are also disclosed in the sub-claims and combinations of them.

BRIEF DESCRIPTION OF THE DRAWINGS

An example embodiment of the invention is explained below on the basis of figures. Features disclosed by the figures, each individually and in any combination of features, advantageously develop the subjects of the claims and the embodiments described above. There is shown:

DETAILED DESCRIPTION OF THE DRAWINGS

Figure 1:
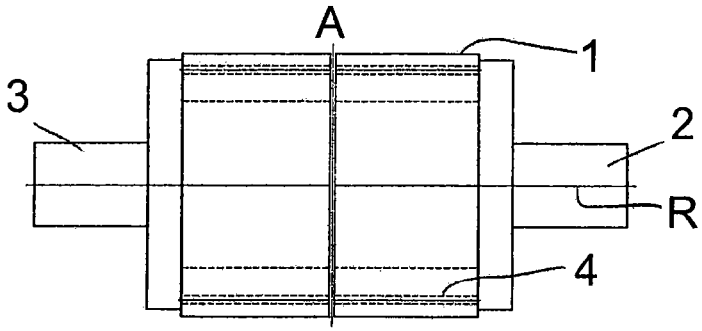
FIG. 1 illustrates an exemplary roller comprising a roller body in accordance with the invention.

FIG. 1 shows a roller for treating a web material, for example a calender roller, comprising a roller body 1 and two flange trunnions 2 and 3, one of which is mounted on the left-hand facing side of the roller body 1 and the other of which is mounted on the right-hand facing side of the roller body 1. The roller is mounted in the region of the trunnion flanges 2 and 3 such that it can be rotated about a rotational axis R or is provided in order to be rotationally mounted. For thermally treating the web material, a thermal fluid can be supplied in the roller body 1 via one of the trunnion flanges 2 and 3 and can be drained off again via the other or preferably via the same trunnion flange 2 or 3. Continuous peripheral thermal treatment channels 4 near the outer circumference of the roller body 1 pass through the roller body 1 from one axial end to the other, and the thermal fluid flows through said channels while the material is being thermally treated.

Figure 2:
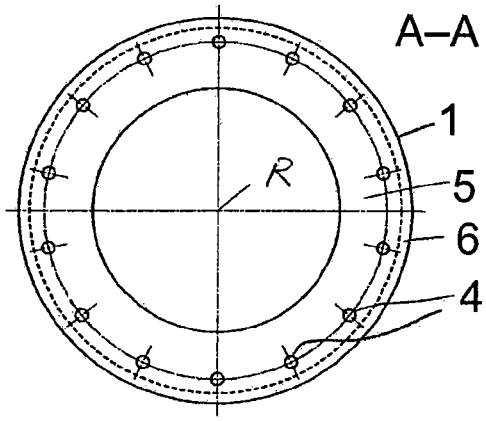
FIG. 2 is a cross-section along the line A-A in FIG. 1.

FIG. 2 shows the roller body 1 in the cross-section A-A. A central hollow space is formed axially and continuously in the roller body 1. The roller body 1 is a cast body. It is cast, upright, by gravity die casting, for example by static gravity die casting, from a molten mass of an iron base alloy. The central hollow space is formed directly during this original moulding or is subsequently machined. A cast iron alloy is used as the iron base alloy. The cooling which the molten mass primarily experiences on the die is controlled in such a way that the molten mass solidifies stably in a spheroidal graphite casting structure, i.e. in the form of a cast iron with spheroidal graphite, over the entire axial length of the roller body 1 from radially inwards to radially outwards, up to the outer circumference or almost up to the outer circumference. The cooling is controlled by correspondingly configuring the die. The cooling speed can in particular be set via the radial thickness of the die, the thermal capacity of the die, the thermal conductivity of the material of the die or the total mass of the die. For setting the cooling speed, the die can be configured, by correspondingly selecting materials and dimensioning the die, in relation to one of said parameters only or in relation to a combination of two, three or all four of said parameters.

The solidifying process is controlled in such a way that the molten mass stably solidifies not only in an interior zone 5 which surrounds the rotational axis R but also in a circumferential rim zone 6 which surrounds the interior zone 5 and forms the outer circumference of the roller body 1. The roller body 1 thus solidifies stably and not white over its entire cross-section. During stable solidification, the carbon is dispersed in the form of spheroidal graphite. The roller body 1 obtained directly by the casting process thus exhibits a spheroidal graphite casting structure throughout. Due to the cooling speed being specifically set by means of the die, however, the graphite is dispersed more finely in the circumferential rim zone 6 than in the interior zone 5. The graphite spherolites SG (spheroidal graphite particles) of the circumferential rim zone 6 have a size in the range of index values from 5 to 8, i.e. maximum dimensions of at most 0.12 mm. The cooling speed is more preferably set such that the graphite particles SG of the circumferential rim zone 6 have a size in the range of index values from 7 (0.022 mm) to 8 in accordance with EN ISO 945, i.e. maximum dimensions of at most 0.03 mm. The cast iron matrix is also pearlitic in the circumferential rim zone 6, but with a low proportional ferrite content. The proportional pearlite content is at least 90%, more preferably at least 95%, and the proportional ferrite content is at most 10%, more preferably at most 5%. If the formation of carbides cannot be prevented, the proportional carbide content is below 5%, more preferably below 3%, not only in the interior zone 5 but also in the circumferential rim zone 6 which is solidified at a higher cooling speed.

Figure 3:
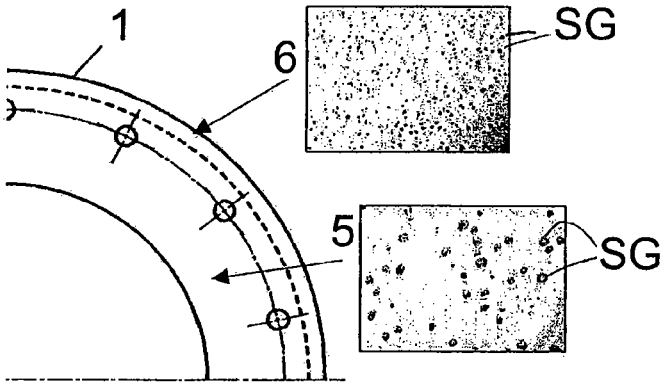
FIG. 3 shows an enlarged detail of a portion of FIG. 2 regarding the micro-structure of the roller body.

FIG. 3 shows a detail from FIG. 2 and also, separately, an even further enlarged representation of the micro-structure of the roller body as obtained by casting, showing the structures of the interior zone 5 and the circumferential rim zone 6 which differ with regard to the fineness of the dispersed graphite particles SG. The micro-structures shown next to the cross-section of the roller body 1 are primarily schematic in nature, but illustrate qualitatively that the graphite particles SG in the circumferential rim zone 6 are smaller than the graphite particles SG in the interior zone 5 and that the graphite particles SG in the circumferential rim zone 6 correspondingly occur in a finer distribution.

In a subsequent hardening process, the roller body 1 is made wear-resistant in its more highly stable circumferential rim zone 6 such as is already obtained by casting. The peripheral thermal treatment channels 4 are machined, preferably drilled, before or after hardening. The circumferential rim zone 6 is understood to mean the annular zone of the roller body 1 which, after hardening, exhibits the hardness required for the respective application throughout, i.e. which extends from the outer circumference as far as the hardness penetration depth. If the circumferential rim zone 6 of the hardened roller body 1 extends radially inwards as far as or even beyond the thermal treatment channels 4, the latter are expediently machined before hardening. Conversely, the thermal treatment channels 4 can just as well be machined only after hardening.

The hardening process is performed such that the basic structure of the circumferential rim zone 6 which is obtained directly from casting is transformed into ribbon grain pearlite or even more advantageously into superfine ribbon grain pearlite. This does not alter the graphite spherolites SG or at least not in a way which is crucial to the invention. As an alternative to the transformation into ribbon grain or superfine ribbon grain pearlite, i.e. into sorbite or troostite, the hardening process can also be designed such that the cast iron matrix is transformed within the circumferential rim zone 6 into an intermediate structure, preferably into ADI (austempered ductile iron). In both variants, the circumferential rim zone 6 of the roller body 1 is heated evenly to a temperature in the austenitic range, for example to 950° C., and then quenched, wherein the quenching speed for forming an intermediate structure is set higher than for transforming into fine pearlite, but still not high enough that a martensitic transformation can occur. The intermediate structure is similar to bainite, preferably lower bainite, but is not bainite since it does not contain carbides or only negligibly few carbides for the desired stability. It is also true of the intermediate structure that the proportional carbide content is advantageously less than 5% and preferably at most 3%. In the sense of the invention, it would be ideal if neither the fine pearlitic structure nor the alternative intermediate structure contained carbides.

Figure 4:
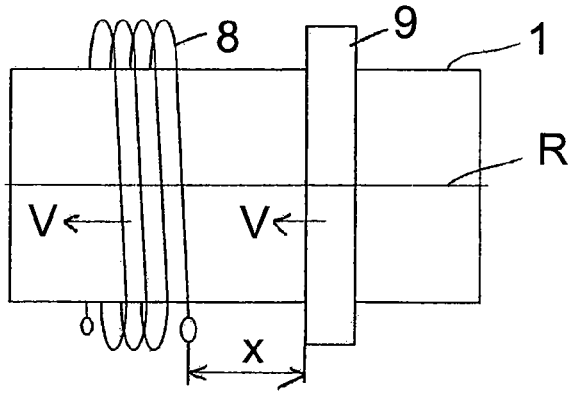
FIG. 4 illustrates the roller body during a thermal surface treatment.

FIG. 4 illustrates a hardening process, taking the preferred example of induction hardening. For the purpose of hardening, an induction means 8 and a quenching means 9 are moved axially from one facing end of the roller body 1 to the other. The movement is uniform at the velocity v and at an axial distance x which is constant during the hardening process and by which the induction means 8 precedes the quenching means 9. The induction means 8 and the quenching means 9 surround the roller body 1. By means of the induction means 8, the roller body 1 is heated evenly and throughout as far as the predetermined hardness penetration depth, i.e. within the circumferential rim zone 6, up to the temperature range mentioned and then quenched by means of the quenching means 9. The roller body 1 is preferably quenched using a liquid quenching fluid, for example water, which is sprayed onto the outer circumference of the roller body 1. Although induction hardening is a preferred method for hardening by thermal surface treatment, the circumferential rim zone 6 can in principle also be heated by means of any other method of thermal surface treatment, as long as only the required temperature is set with the required evenness. Flame hardening in particular can be considered as an alternative to induction hardening, but primarily only for lower hardness penetration depths. As the hardness penetration depth increases, induction hardening is the preferred choice. The hardness penetration depth and accordingly the thickness of the circumferential rim zone 6 is preferably at least 3 mm, more preferably at least 5 mm. Conversely, it is advantageous with regard to temperature-change stresses if the hardness penetration depth does not exceed 10 mm. The hardness penetration depth can in particular be influenced by varying the distance x—in the case of induction hardening, also by varying the frequency of the respective induction coil 8. Other actuating parameters for influencing the hardness penetration depth are the velocity v, the choice of quenching fluid and the throughput of quenching fluid.

Figure 5:
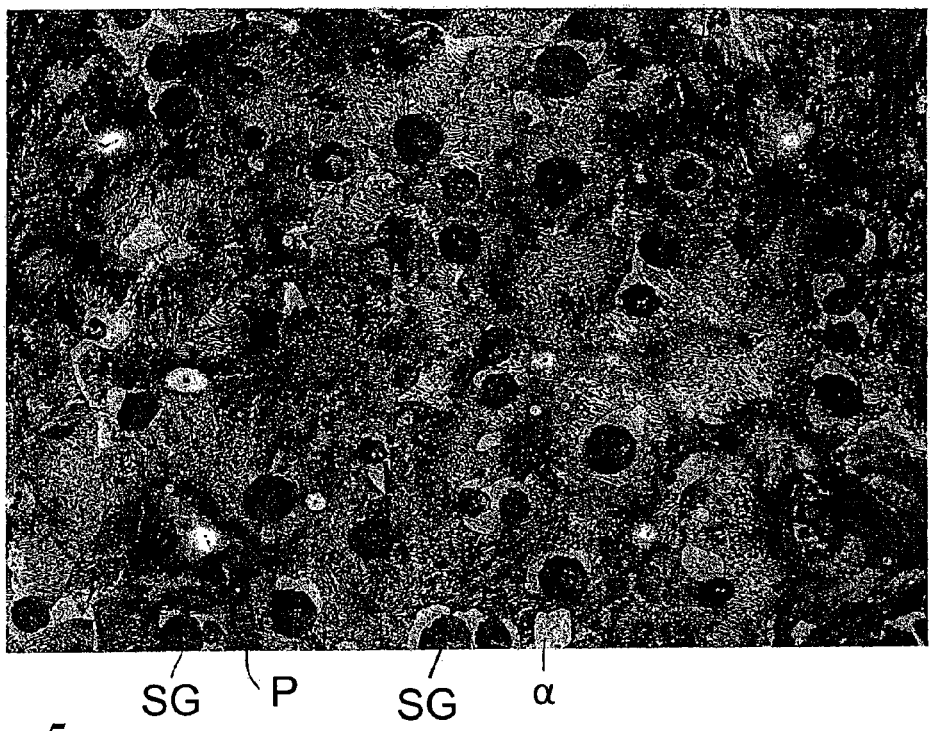
FIG. 5 is a micrograph of the basic structure of the roller body.
Figure 6:
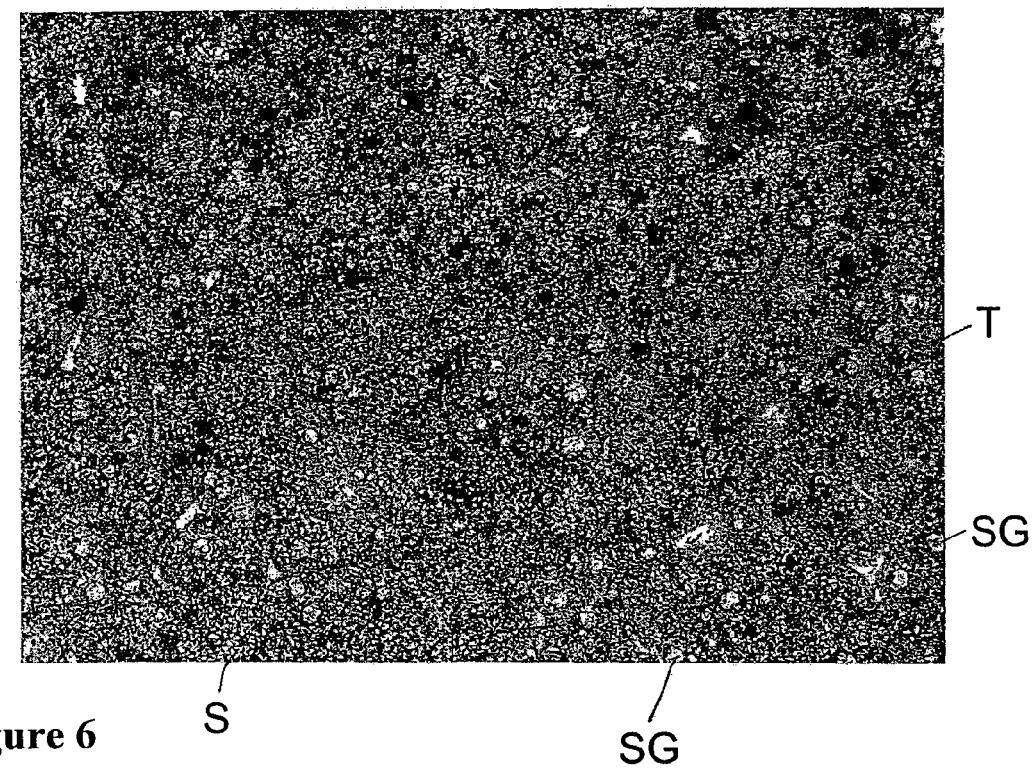
FIG. 6 is a micrograph of the structure of a circumferential rim zone of the roller body which has been hardened by means of the thermal surface treatment.

FIGS. 5 and 6 are micrographs of the structure of the circumferential rim zone 6. FIG. 5 shows the basic structure obtained directly by casting, at a scale of 50:1, and FIG. 6 is a micrograph of the structure after hardening, i.e. it shows the hardness structure, likewise at a scale of 50:1. In the basic structure in FIG. 5, the graphite pebbles or graphite spherolites are indicated by SG, the pearlite is indicated by P, and ferrite islands are indicated by α. As can be seen, the basic structure consists substantially of pearlite and dispersed spheroidal graphite, as well as small amounts of ferrite—in the example embodiment, less than 10% ferrite. The hardness structure consists of ribbon grain and superfine ribbon grain pearlite, i.e. sorbite and troostite, as well as the embedded spheroidal graphite particles SG, wherein the pearlite regions are indicated by S for sorbite and T for troostite, depending on the fineness of the leaves.

Figure 7:
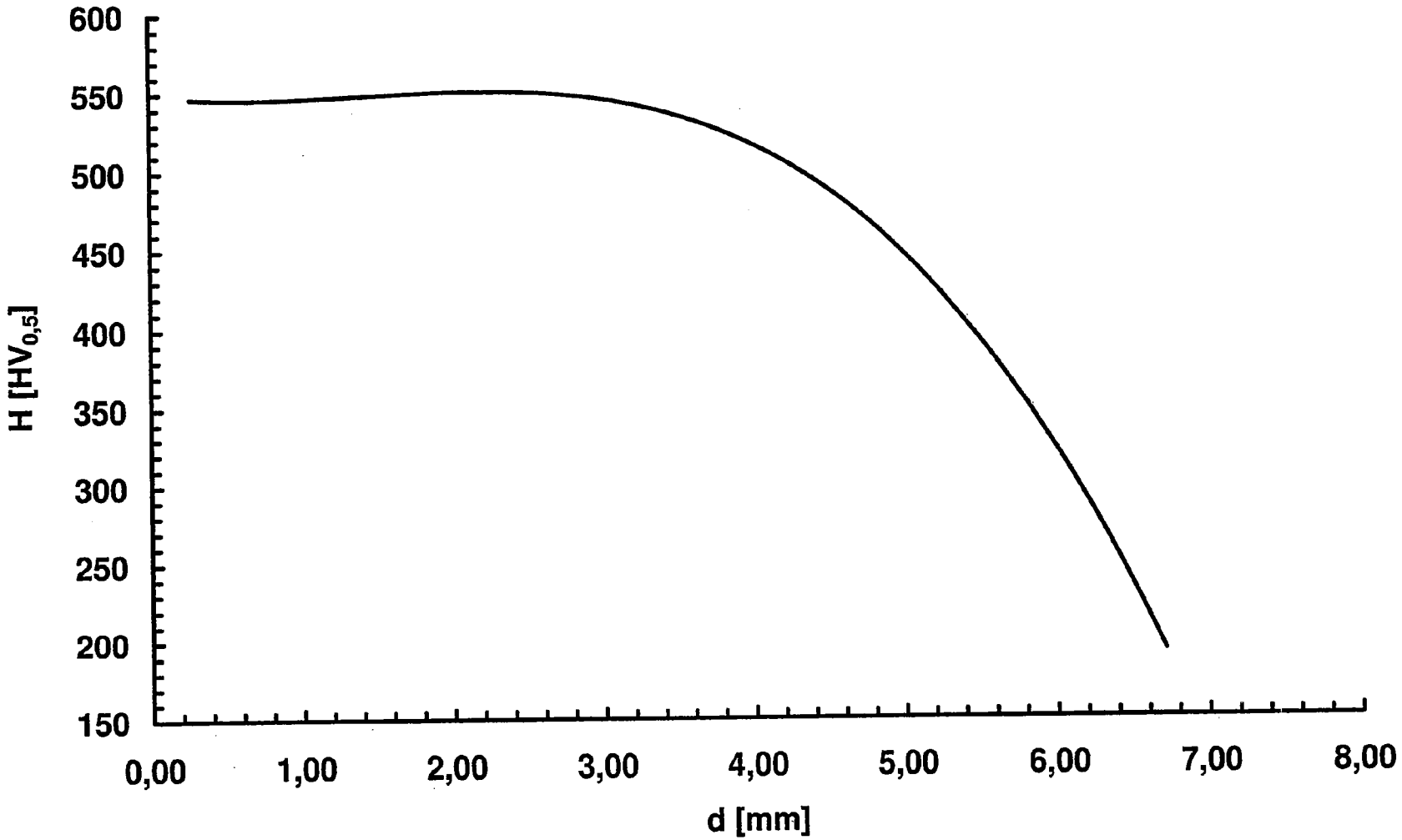
FIG. 7 shows the microhardness profile in the hardened circumferential rim zone.

FIG. 7 shows the microhardness profile at the predetermined hardness penetration depth of 3 mm, i.e. the hardness H in HV0.1 over the distance d from the outer circumference of the roller body 1, i.e. over the depth d.

The hardened roller body 1 is tempered, advantageously to a tempering temperature of between 300° C. and 350° C.

In the following table, an iron base alloy which is particularly preferred for casting the roller body 1 is specified in the first column of the table. The second and third columns contain preferred ranges for the respective co-constituent in the alloy, wherein the narrower ranges within the respectively wider range for the same alloy element are particularly preferred. The proportional content specified in the final column is then in turn the most preferred for the respective co-constituent in the alloy. In a preferred embodiment, the iron base alloy contains at least carbon, silicon, copper and nickel within the respectively specified proportional content ranges. Copper as a pearlite former, and nickel for preventing a martensitic transformation, are preferably used in combination. The rest of the respective alloy is iron.

| Alloy element | Proportional content in % by mass | Proportional content in % by mass | Proportional content in % by mass |
|---|---|---|---|
| C | 3.0-4.0 | 3.4-3.8 | 3.6 |
| Is | 1.7-2.4 | 1.9-2.2 | 2.1 |
| Cu | 0.5-1.3 | 0.7-1.0 | 0.90 |
| Ni | 0.3-1.5 | 0.7-1.0 | 0.85 |
| Mn | ≤0.5 | ≤0.5 | 0.35 |
| Sn | ≤0.05 | ≤0.05 | 0.01 |
| P | <0.1 | <0.05 | ≤0.03 |
| S | <0.1 | <0.05 | ≤0.01 |

Alloy elements in the iron base alloy

The iron base molten mass having the composition of the final column exhibits a degree of saturation of scandium of 0.99 to 1.00. Iron base alloys having a degree of saturation of scandium in the range of 0.97 to 1.03 are preferred, wherein in the range of alloys having a near-eutectic composition, those having a degree of saturation of scandium in the lower half of the specified range are preferred.

On the basis of a sample which was cast and hardened in accordance with the method in accordance with the invention, comprising ribbon grain and superfine ribbon grain pearlite with spheroidal graphite, on the basis of which the micrographs in FIGS. 4 and 5 were also taken and the hardness profile in FIG. 6 produced, the measurements taken in a tensile experiment yielded the following properties with regard to stability and hardness:

(i) 0.2% proof stress $R_{P,0.2}$>400 N/mm$^2$;

(ii) tensile strength $R_m$>650 N/mm$^2$;

(iii) elongation at rupture A>3-4%;

(iv) hardness>400 HV.

The roller body 1 of the example embodiment is solidified in a spheroidal graphite casting structure. In alternative embodiments, the embedded free graphite in the interior zone 5 and also in the circumferential rim zone 6 can be dispersed substantially in the form of vermicular graphite or also in the form of spheroidal graphite and vermicular graphite. However, dispersing spheroidal graphite is preferred to dispersing vermicular graphite. In embodiments in which the free graphite occurs as spheroidal graphite and also as vermicular graphite, it is advantageous if a predominant portion of the free graphite is spheroidal graphite.

The invention claimed is:

1. A roller body for a roller for treating a material, wherein the roller body is cast from an iron base alloy which forms a radially interior zone of the roller body made of grey cast iron and, around the interior zone, a circumferential rim zone which includes the outer circumference of the roller body and has a surface hardness which is greater than 400 HV, wherein the circumferential rim zone comprises ribbon grain or superfine ribbon grain pearlite with embedded free graphite, wherein the embedded free graphite is at least substantially spheroidal graphite and graphite pebbles of said spheroidal graphite in the solidified circumferential rim zone exhibit a size which corresponds to an index value of at least 5 and at most 7 in accordance with EN ISO 945, and wherein pearlite content is greater than 90% in the circumferential rim zone.

2. The roller body according to the claim 1, wherein the material of the circumferential rim zone exhibits at least one of the following stability values:

(i) 0.2% proof stress $R_{p,0.2}$>400 N/mm$^2$;

(ii) tensile strength $R_m$>600 N/mm$^2$; or (iii) elongation at rupture A>1.5%.

3. The roller body according to the claim 2, wherein the material of the circumferential rim zone exhibits a tensile strength Rm22 650 N/mm$^2$.

4. The roller body according to the claim 2, wherein the material of the circumferential rim zone exhibits elongation at rupture A22 2%.

5. The roller body according to claim 1, wherein the roller body comprises peripheral bores distributed about its central longitudinal axis for conducting a thermal fluid.

6. The roller body according to claim 1, wherein the roller body is a constituent of the roller, and trunnion flanges are fastened to the axial ends of the roller body in order to rotationally mount the roller.

7. The roller body according to claim 1, wherein the freely embedded graphite is spheroidal graphite or vermicular graphite.

8. The roller body according to claim 1, wherein the iron base alloy contains at least 0.3% nickel and at most 1.5% nickel.

9. The roller body according to claim 1, wherein the iron base alloy contains at least 0.5% copper and at most 1.3% copper.

10. The roller body according to claim 1, wherein the iron base alloy is composed in such a way that the martensite starting temperature of the cast iron is lower than 20° C.

11. The roller body according to claim 1, wherein the iron base alloy contains at least 1.7% silicon and at most 2.4% silicon.

12. The roller body according to claim 1, wherein the iron base alloy contains 3% - 4% carbon.

* * * * *

UNITED STATES PATENT AND TRADEMARK OFFICE

CERTIFICATE OF CORRECTION

PATENT NO. : 8,684,895 B2
APPLICATION NO. : 12/686700
DATED : April 1, 2014
INVENTOR(S) : Ulrich Severing, Bernd Eppli and Lutz Krodel-Teuchert It is certified that error appears in the above-identified patent and that said Letters Patent is hereby corrected as shown below:

Insert on the Title Page ITEM -- (30) Foreign Application Priority Data

January 14, 2009 (DE) 10 2009 004 562.7 --

Signed and Sealed this
Seventeenth Day of June, 2014

Michelle K. Lee

Michelle K. Lee
*Deputy Director of the United States Patent and Trademark Office*